US011652305B2

(12) United States Patent
Binder et al.

(10) Patent No.: US 11,652,305 B2
(45) Date of Patent: May 16, 2023

(54) ELECTRICAL ASSEMBLY

(71) Applicant: WIKA Alexander Wiegand SE & Co. KG, Klingenberg (DE)

(72) Inventors: Sebastian Binder, Rossdorf (DE); Ulrich Staab, Biebergemuend (DE)

(73) Assignee: WIKA Alexander Wiegand SE & Co. KG, Klingenberg/Main (DE)

( * ) Notice: Subject to any disclaimer, the term of this patent is extended or adjusted under 35 U.S.C. 154(b) by 34 days.

(21) Appl. No.: 17/553,086

(22) Filed: Dec. 16, 2021

(65) Prior Publication Data

US 2022/0200173 A1 Jun. 23, 2022

(30) Foreign Application Priority Data

Dec. 18, 2020 (DE) ..... 10 2020 134 268.3

(51) Int. Cl.
*H01R 12/50* (2011.01)
*H01R 12/51* (2011.01)
*H01R 12/58* (2011.01)

(52) U.S. Cl.
CPC ..... *H01R 12/515* (2013.01); *H01R 12/585* (2013.01)

(58) Field of Classification Search
CPC .... H01R 12/515; H01R 12/585; H01R 12/50; H01R 12/58; H01R 13/5804; H01R 13/582; H01R 13/621; H01R 13/627; H01R 33/7621; H01R 33/7628; H01R 33/7614; H01R 4/30; H01R 40/302; H01R 40/305; H01R 40/38; H01R 40/02; H01R 40/42; H01R 40/44; H01R 40/506; H01R 40/5075; H01R 40/5091; H01R 9/0524; H01R 13/5812; H01R 13/5808
See application file for complete search history.

(56) References Cited

U.S. PATENT DOCUMENTS 3,676,836 A * 7/1972 Gillemot ..... H01R 4/64 439/799
4,002,390 A * 1/1977 Perry ..... H01R 11/12 439/433
5,188,544 A * 2/1993 Mukai ..... H01R 11/12 439/907
5,486,434 A * 1/1996 Aoyama ..... H01R 11/283 439/756
5,506,514 A * 4/1996 Difrancesco ..... B23K 20/16 439/74

(Continued)

*Primary Examiner* — Harshad C Patel
(74) *Attorney, Agent, or Firm* — Muncy, Geissler, Olds & Lowe, P.C.

(57) ABSTRACT

An electrical assembly having a housing with a housing pot and a housing cover closing the housing pot and at least two connection terminals provided for the electrical connection of the assembly. The connection terminals each comprise a base plate, a clamping plate, which can be arranged on the base plate, for clamping at least one electrical conductor between the base plate and the clamping plate, a contact pin protruding into the housing pot, and a screw for fastening the clamping plate to the base plate. The housing pot is a hollow cylinder with a closed bottom and the electrical connection terminals are arranged along an imaginary circular line on the housing. The base plates and/or the clamping plates each have a trapezoidal base area.

10 Claims, 7 Drawing Sheets

(56) References Cited

U.S. PATENT DOCUMENTS

| | | | | |
|---|---|---|---|---|
| 6,902,434 | B2 * | 6/2005 | Stack | H01M 50/552 439/620.28 |
| 7,074,095 | B2 * | 7/2006 | Perng | H01R 11/281 439/766 |
| 7,115,000 | B1 * | 10/2006 | Huang | H01R 4/34 439/427 |
| 7,458,861 | B1 * | 12/2008 | Eke | H01R 4/64 439/97 |
| 8,338,710 | B2 * | 12/2012 | Maguire | H01R 11/284 324/110 |
| 2016/0230800 | A1 * | 8/2016 | Sawai | F16B 37/04 |
| 2017/0077626 | A1 * | 3/2017 | Yamada | H01R 11/283 |
| 2021/0206217 | A1 * | 7/2021 | Angermann | B62D 53/08 |

* cited by examiner

ELECTRICAL ASSEMBLY

BACKGROUND OF THE INVENTION

This nonprovisional application claims priority under 35 U.S.C. § 119(a) to German Patent Application No. 10 2020 134 268.3, which was filed in Germany on Dec. 18, 2020, and which is herein incorporated by reference.

Field of the Invention

The present invention relates to an electrical assembly.

Description of the Background Art

Electrical assemblies are generally known from the prior art.

SUMMARY OF THE INVENTION

It is therefore an object of the present invention to provide an electrical assembly which is improved over the prior art.

In an exemplary embodiment, an electrical assembly of the invention comprises a housing with a housing pot and a housing cover closing the housing pot. Furthermore, the assembly comprises at least two connection terminals provided for the electrical connection of the assembly. The connection terminals each comprise a base plate, a clamping plate, which can be arranged on the base plate, for clamping at least one electrical conductor between the base plate and the clamping plate, a contact pin protruding into the housing pot, and a screw for fastening the clamping plate to the base plate. The base plate in the connection, in particular a one-piece connection, with the contact pin is also referred to as a contact clip or clamping clip. The housing pot is a hollow cylinder with a closed bottom and the electrical connection terminals are arranged along an imaginary circular line on the housing, wherein the base plates and/or the clamping plates have a trapezoidal base area.

The electrical assembly can be manufactured particularly economically and is characterized by a very compact design. Due to the trapezoidal shape of the base plates and/or the clamping plates, a very compact arrangement of a large number of connection terminals on the housing can be achieved.

The connection terminals can be arranged along the imaginary circular line such that a longer base side of the trapezoidal base plates and/or clamping plates points radially outward starting from a center point of a circle enclosed by the circular line. As a result, a number of connection terminals arranged in a circle can be maximized.

The contact pin can be integrally formed on the base plate and is guided through the housing pot or the housing cover by means of a press fit. As a result, in addition to realizing the particularly compact design, on the one hand, particularly easy assembly and disassembly of the assembly can be achieved and, on the other hand, high requirements for the tightness of the assembly can be met in a particularly simple way.

The contact pin can have an oversize of 50 μm to 300 μm, in particular an oversize of an average of 100 μm, relative to an opening into which it is pressed. This enables a particularly secure and simple press fit of the contact pin.

A circular opening for the passage of the screw can be formed in the clamping plate, so that the clamping plate can be easily fastened to the base plate.

The opening can be arranged in an eccentric position in the clamping plate, so that simple and reliable clamping of the electrical conductor is possible and, despite the small dimensions of the connection terminals, conductors with large conductor cross sections can be securely clamped.

The opening can have a diameter of 3.5 mm.

The circular opening can be formed closer to the longer base side of the trapezoidal clamping plate than to an opposite, shorter base side. This enables simple and reliable clamping of the electrical conductor and, despite the small dimensions of the connection terminals, conductors with large conductor cross sections can be securely clamped.

The circular opening can be formed at 30% to 50% or 40% to 50% or at approximately 45%, in particular 45.7%, of a distance from a longer base side to a shorter base side of the clamping plate. Such an arrangement of the opening has proven to be particularly advantageous for the arrangement of the screw and the clamping of the electrical conductor.

The screw can be captively held in the clamping plate by a form fit or a groove. This enables simple and safe handling of the clamping plate with the pre-mounted screw. Due to the pre-mounting, the clamping plate can be fastened to the base plate together with the screw in a simple manner and the screw can be screwed into a corresponding thread.

The diameter of the cylindrical housing can be between 45 mm and 55 mm, in particular between 49 mm and 51 mm.

At least six connection terminals can be arranged on a flattened side of the housing. The arrangement of the connection terminals on the flattened side enables very compact dimensions of the assembly.

A ratio of the diameter of the housing to the length of a respective base plate of a connection terminal can be between 8:40 and 8:60, in particular 8:50.

A length of the longer base side of the clamping plate and/or the base plate can be 8 mm.

A length of the shorter base side of the clamping plate and/or the base plate can be 6.4 mm.

A distance between the longer base side and the shorter base side of the clamping plate and/or the base plate can be 7 mm.

A thickness of the clamping plate can be 0.8 mm to 1.2 mm.

The housing pot and the housing cover can be connected to one another by means of a snap connection, a form fit, or a press fit, wherein the housing pot relative to the housing cover or the housing cover relative to the housing pot has in particular an oversize of 50 μm to 300 μm, preferably an oversize of 100 μm on average. This enables a particularly secure and easily realizable connection between the housing pot and the housing cover.

The form fit between the housing pot and the housing cover can be produced via a riveted connection. The riveted connection may be produced, for example, in a so-called hot caulking method.

The housing pot and the housing cover can each have a circular segment-shaped cutout on their edge and/or each have a circular cutout in their center. These cutouts make it possible in an advantageous manner that electrical lines that are to be connected to the connection terminals can be fed from the underside of the electrical assembly and can be run in a compact manner either through the central circular cutout or close to the edge of the housing, along the lateral circular segment-shaped cutout. Thus, the electrical assembly can advantageously be used in tight installation situations and connected to electrical lines. Furthermore, a lateral circular segment-shaped cutout enables installation secured against rotation in an assembly receptacle which has a corresponding formation engaging in the cutout. Such an assembly receptacle can in particular be a head transmitter housing.

The housing pot and the housing cover can be integrally bonded to one another by means of a potting compound. Alternatively or in addition, the housing can be filled with a potting compound. Particularly high requirements for tightness of the assembly can be met in a particularly simple manner by this means. A simple and reliable electrical insulation of components and contacts present in the interior of the housing can also be realized.

At least one circuit board each can be fixed on the contact pins with a solder and the circuit boards are each brought into contact with at least one integrally formed wall section of a housing part. The circuit boards enable a large number of electrical interconnections and functions to be realized in a particularly small installation space. Furthermore, the contact pins with the circuit boards fixed thereon are particularly easy to handle.

Wall sections, which are integrally formed toward the outside on the housing, separate the base plates from one another. This enables, on the one hand, a simplified assembly of the connection terminals and, on the other hand, a secure spacing and electrical insulation of the base plates and thus of the connection terminals from one another.

The base plates can be fixed with wall sections to the housing part by means of a hot stamping method. This enables simple handling and assembly of a housing part, for example, the housing cover, and of the base plates.

The connection terminals can each be covered by a cover, wherein the cover has a circular cutout which is arranged centrally above the screw, and has at least one coupling point for locking elements of a display. The covers enable mechanical protection of the connection terminals and the clamped electrical conductors as well as contact protection. The circular cutout allows easy access to the corresponding screw. Furthermore, with the formation of the coupling points, for example, by means of projections for hooking in snap arms, an arrangement and attachment of a display are possible in a simple manner.

The clamping plates can have a guide nose and the covers can have a complementary cutout. This enables a rotationally fixed and guided securing of the covers to the clamping plates.

Further, the clamping plate and/or the screw can be galvanized. Galvanizing enables a high resistance to corrosion.

An energy storage device and/or an antenna are disposed within the housing pot and are electrically connected to a circuit board. The antenna is used for the contactless charging of the energy storage device, which is designed as a rechargeable battery, for example, or for radio communication with external units, such as, for instance, wirelessly connectable mobile devices or data technology systems. The electronic assembly can thus also be programmed and configured by radio. It is possible furthermore to communicate with a mobile application/app or a display via the radio interface. A radio connection can also be used as a redundancy to a wired interface in order to enable a reliable data connection in the event of an interruption in the cable connection or a faulty connection.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
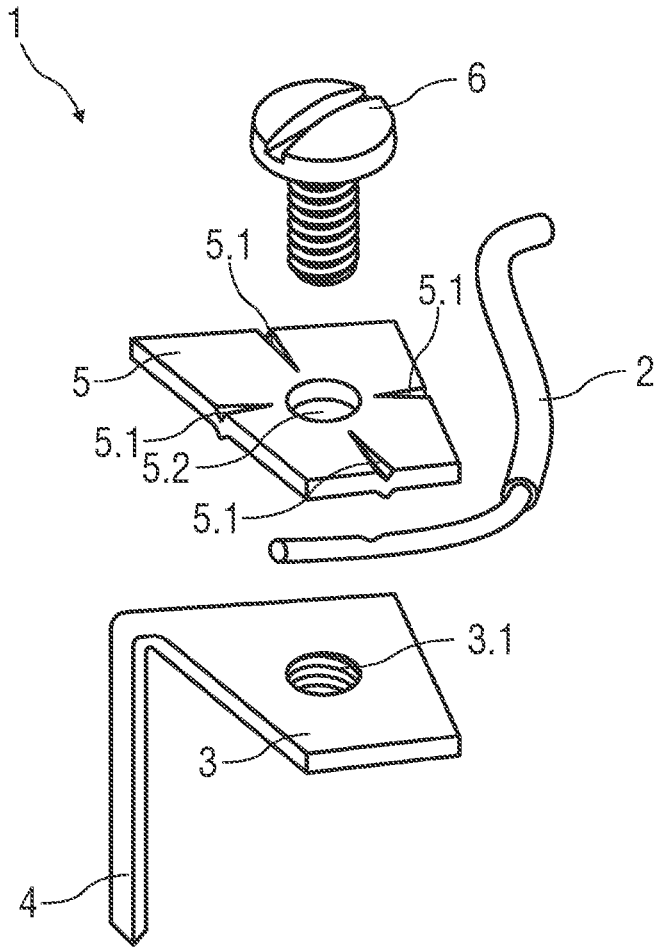
FIG. 1 schematically shows a perspective exploded view of a connection terminal and a section of an electrical conductor.

A perspective exploded view of a connection terminal 1 and of a section of an electrical conductor 2 is shown in FIG. 1.

Connection terminal 1 comprises a base plate 3 with a contact pin 4 protruding substantially vertically from a surface of base plate 3, a clamping plate 5, which can be arranged on base plate 3, for clamping electrical conductor 2 between base plate 3 and clamping plate 5, and a screw 6 for fastening clamping plate 5 to base plate 3.

Base plate 3 and clamping plate 5 each have a trapezoidal base area. For example, clamping plate 5 is galvanized to protect against corrosion.

For secure clamping of conductor 2, clamping plate 5 has a corresponding clamping structure 5.1 which, in one possible embodiment, deforms electrical conductor 2 in sections when clamping plate 5 is mounted on base plate 3.

To fasten clamping plate 5 to base plate 3 by means of screw 6, base plate 3 has an opening 3.1 with a corresponding internal thread. Clamping plate 5 has a circular opening 5.2 for screw 6 to pass through. Screw 6 is captively held in opening 5.2, for example, by a form fit or a groove.

Connection terminal 1 is provided for an arrangement on an electrical assembly 7 and for an electrical connection of the same.

Figure 2:
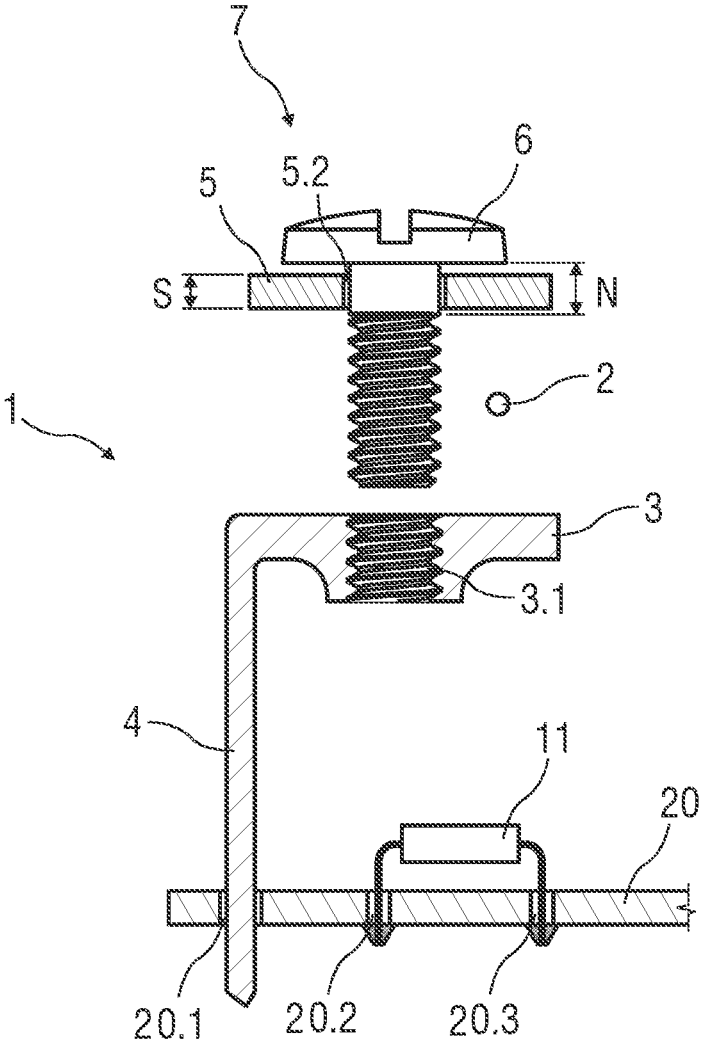
FIG. 2 schematically shows a sectional exploded view of a detail of an electrical assembly.

FIG. 2 shows a sectional exploded view of a detail of a possible exemplary embodiment of such an electrical assembly 7.

Assembly 7 comprises a circuit board 20, wherein electronic components 11 are arranged thereon, for example, inserted into holes 20.2, 20.3, and are connected to the circuit board by a solder. Circuit board 20 is arranged within a housing 8 (not shown in FIG. 2), which comprises a housing pot 9 and a housing cover 10 closing housing pot 9.

Connection terminal 1 is arranged outside such a housing 8, in particular on a flattened outer surface of housing cover 10.

Contact pin 4 is inserted into a hole 20.1 in circuit board 20. Contact pin 4 and circuit board 20 are mechanically and electrically connected to one another, for example, by means of a solder (not shown further). There is thus an electrical connection from base plate 3 to circuit board 20.

Furthermore, assembly 7 comprises at least two connection terminals 1 provided for the electrical connection of assembly 7, for example, formed according to FIG. 1.

Figure 3A:
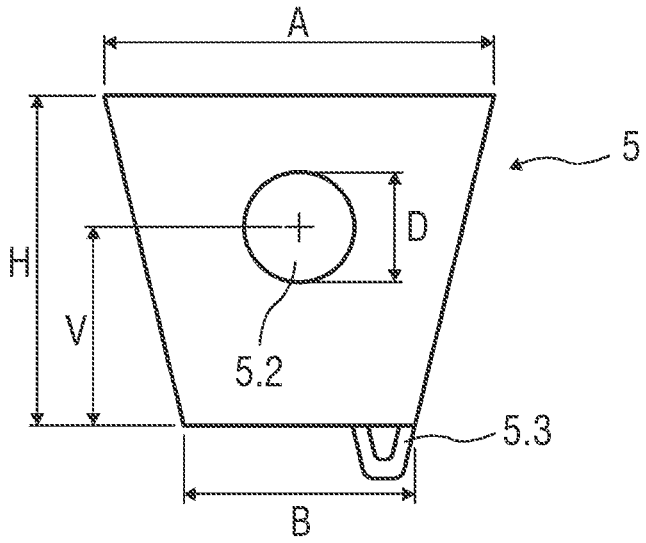
FIG. 3A schematically shows a top view of a clamping plate.

FIG. 3A shows a top view of a clamping plate 5. Clamping plate 5 has a guide nose 5.3.

A longer base side of clamping plate 5 has a length A which is 8 mm, for example.

A shorter base side of clamping plate 5, which is opposite the longer base side, has a length B which is 6.4 mm, for example.

A distance H is formed between the longer base side and the shorter base side of clamping plate 5 and is 7 mm, for example.

Opening 5.2 of clamping plate 5 has a diameter D which is, for example, 3.5 mm.

In this regard, opening 5.2 is formed in an eccentric position in clamping plate 5, in the illustrated exemplary embodiment closer to the longer base side than to the opposite, shorter base side of clamping plate 5. For example, circular opening 5.2 is formed at 30% to 50% or 40% to 50% or at approximately 45%, in particular 45.7%, of a distance from a longer base side to a shorter base side of clamping plate 5. This results in a distance V between a center point of opening 5.2 and the shorter base side.

Figure 3B:
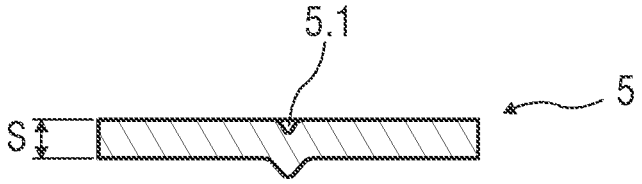
FIG. 3B schematically shows a sectional view of a clamping plate.

A sectional view of a clamping plate 5 is shown FIG. 3B, for example, clamping plate 5 shown in FIG. 3A.

Clamping plate 5 has a thickness S which is, for example, 0.8 mm to 1.2 mm. Furthermore, clamping plate 5 has a clamping structure 5.1 for reliably clamping a conductor 2.

Figure 4:
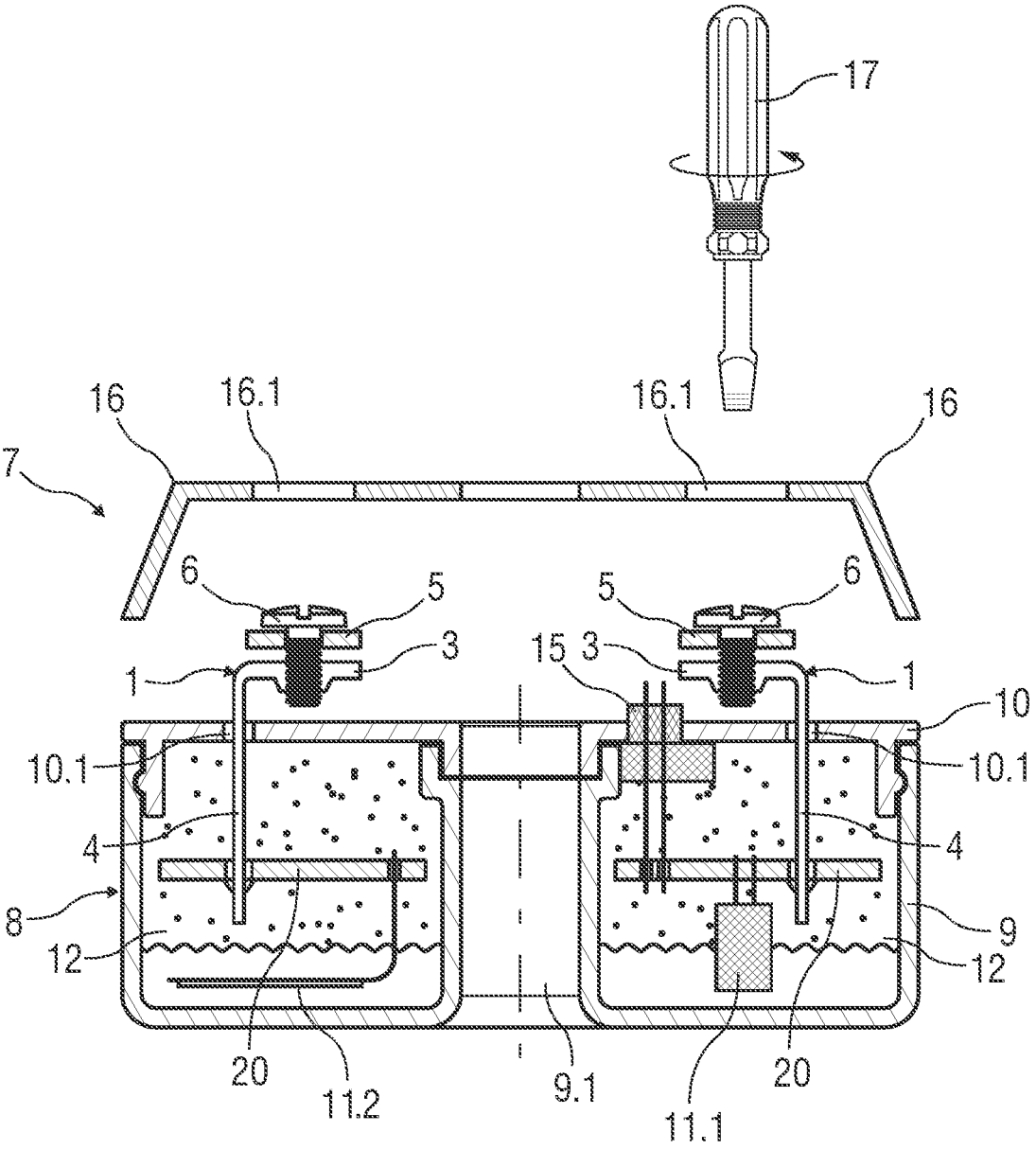
FIG. 4 schematically shows a sectional view of an electrical assembly during assembly.
Figure 5:
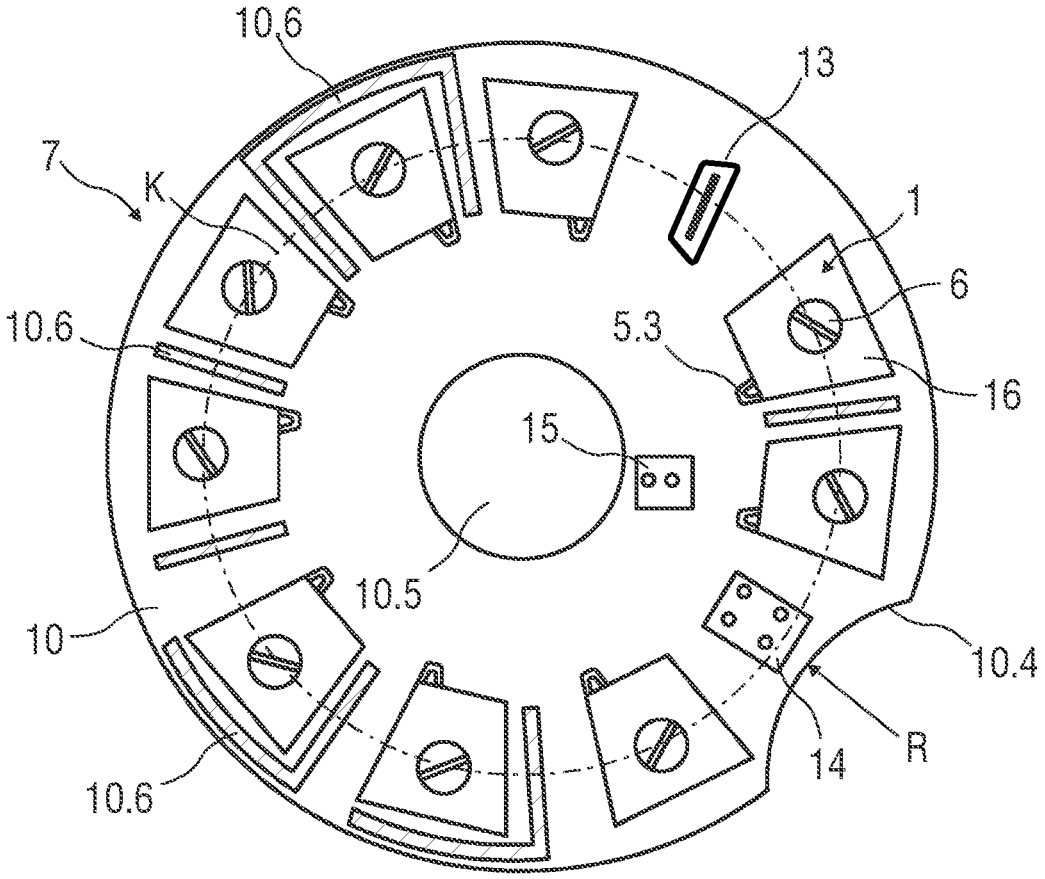
FIG. 5 schematically shows a top view of an electrical assembly.

FIG. 4 shows a sectional view of an electrical assembly 7 during assembly. A top view of electrical assembly 7 is shown in FIG. 5.

A housing 8 of electrical assembly 7 comprises a housing pot 9 and a housing cover 10. Housing pot 9 is a hollow cylinder with a closed bottom and electrical connection terminals 1 are arranged along an imaginary circular line K on a flattened outer side of housing cover 10. In particular, at least six connection terminals 1 are arranged on housing cover 10.

In this case, connection terminals 1 are arranged along the imaginary circular line K such that a longer base side of trapezoidal base plates 3 and clamping plates 5 points radially outward starting from a center point of a circle enclosed by the circular line K.

Between the individual connection terminals 1, in particular between their base plates 3, wall sections 10.6 are integrally formed toward the outside on housing cover 10; these separate base plates 3 and/or connection terminals 1 from one another. Wall sections 10.6 can have different shapes in this case.

Furthermore, connection terminals 1 are each covered by a cover 16, wherein covers 16 each have a circular cutout 16.1, arranged centrally above the respective associated screw 6. This enables screws 6 to be driven by means of a suitable tool 17.

In a manner not shown in more detail, covers 16 have a cutout complementary to guide nose 5.3 of the respective clamping plate 5, so that a rotationally fixed and guided securing of covers 16 to clamping plates 5 is possible.

Furthermore, plug connectors 13, 14 are arranged on housing cover 10 along the imaginary circular line K. A plug connector 15 is provided in addition. Plug connectors 14, 15 can in particular be formed as display connectors, and plug connector 13 can in particular be formed as mini, micro, or type-C USB connectors.

Base plates 3 of connection terminals 1 are arranged on housing cover 10 such that contact pins 4 protrude into housing pot 9. For this purpose, housing cover 10 has a plurality of openings 10.1, wherein contact pins 4 are each guided by a press fit through the respective opening 10.1 of housing cover 10. In this case, contact pin 4 has, for example, an oversize of 50 μm to 300 μm, preferably an oversize of an average of 100 μm, relative to opening 10.1 into which it is pressed.

In an example of the electrical assembly 7, base plates 3 are fixed with wall sections to housing cover 10 by means of a hot stamping method.

Furthermore, at least one circuit board 20 each is fixed to contact pin 4 with a solder. Circuit boards 20 can each be brought into contact with at least one integrally formed wall section of a housing part.

Furthermore, an energy storage device 11.1 and/or an antenna 11.2 are disposed within housing pot 9 and are electrically connected to a circuit board 20. Antenna 11.2 is used for contactless charging of energy storage device 11.1, which is designed as a battery or rechargeable battery, for example, or for radio communication with external units, such as, for instance, wirelessly connectable mobile devices or data technology systems. Electronic assembly 7 can thus also be programmed and configured by radio. It is possible furthermore to communicate with a mobile application/app or a display via the radio interface. A radio connection can also be used as a redundancy to a wired interface in order to enable a reliable data connection in the event of an interruption in the cable connection or a faulty connection.

In the illustrated exemplary embodiment of electrical assembly 7, housing pot 9 and housing cover 10 are connected to one another by means of a snap connection. Alternatively or in addition, a connection to one another by means of a press fit is also possible, wherein housing pot 9 relative to housing cover 10 or housing cover 10 relative to housing pot 9 hereby has in particular an oversize of 50 μm to 300 μm, preferably an oversize of 100 μm on average. A connection to one another by means of a form fit is also possible. For example, the form fit between housing pot 9 and housing cover 10 is produced by means of a riveted connection. The riveted connection is produced, for example, in a so-called hot caulking method.

Furthermore, housing 8 is filled with a potting compound 12, wherein housing pot 9 and housing cover 10 are additionally integrally bonded to one another and sealed by means of potting compound 12.

Further, housing pot 9 and housing cover 10 each have a circular segment-shaped cutout 10.4 on their edge with a radius R and each have a circular cutout 9.1, 10.5 in their center. Even under tight installation conditions, conductors 2 can be fed from the underside of housing 8 to connection terminals 1 by passing them through cutouts 10.5, 9.1 or by arranging them along cutout 10.4 in close contact with the housing. The circular segment-shaped cutout of housing pot 9 is not shown.

Figure 6:
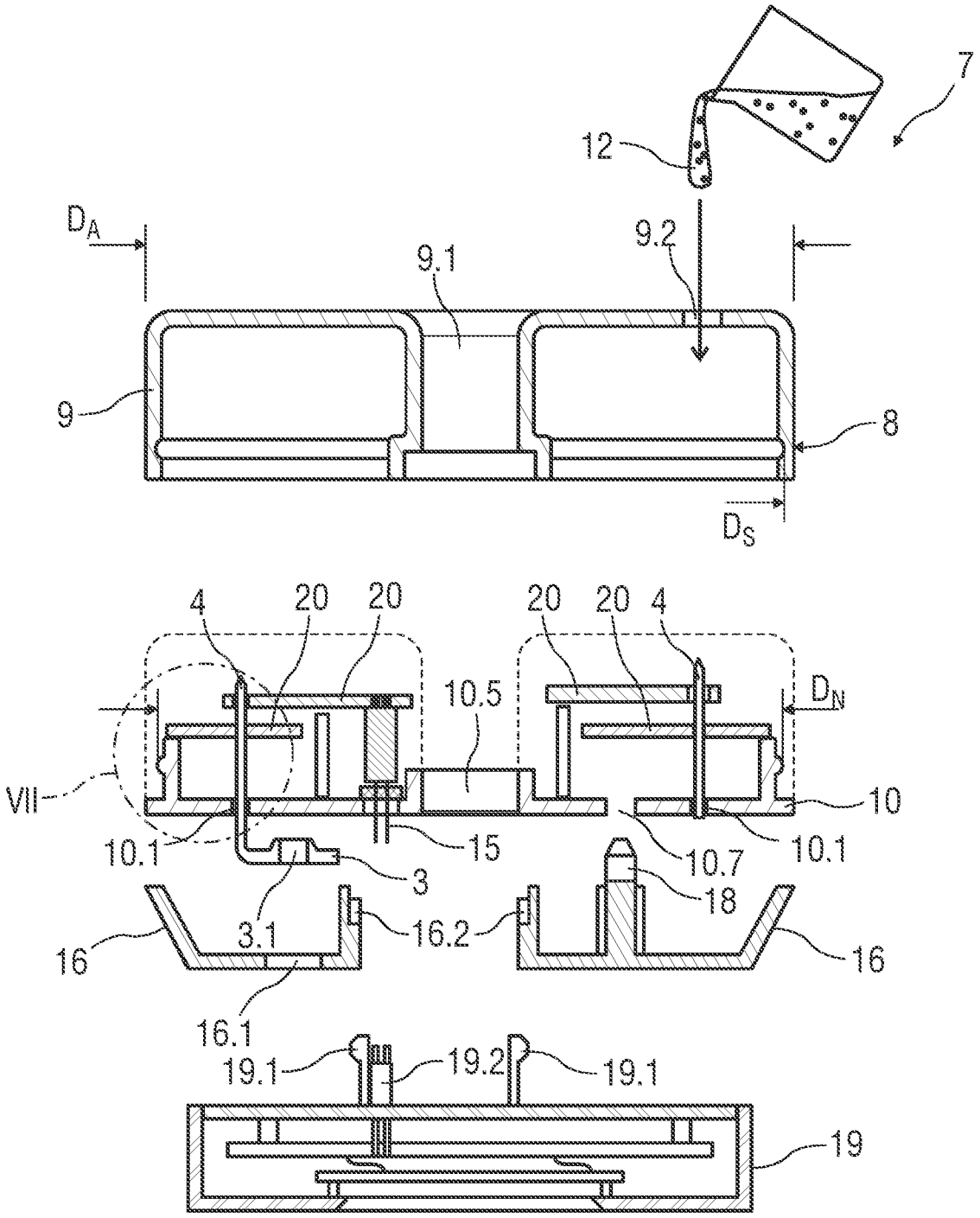
FIG. 6 schematically shows a sectional exploded view of an electrical assembly prior to its assembly.

A sectional exploded view of an electrical assembly 7 prior to its assembly is shown in FIG. 6, wherein assembly 7 corresponds at least substantially to assembly 7 shown in FIG. 4.

There is a closable opening 9.2 in the bottom of housing pot 9 for filling in potting compound 12.

Covers 16 additionally each have at least one coupling point 16.2 for locking elements 19.1 of a display 19. Coupling points 16.2 are formed as projections for hooking in locking elements 19.1 formed as snap arms. A data connection of display 19 takes place via a connection 15 guided out of housing cover 10 and via a display-specific connection 19.2.

The right-hand side of covers 16 further has a pin 18, which can be inserted into a further opening 10.7 of housing cover 10 and then hot-caulked with housing cover 10.

Housing pot 9 has a diameter DA. which is, for example, between 45 mm and 55 mm, in particular between 49 mm and 51 mm. Housing cover 10 has a corresponding diameter DN in the area provided for connection to housing pot 9.

A ratio of the diameter DA of housing 8 to the length of a respective base plate 3 of a connection terminal 1, for example, to the distance H, can be between 8:40 and 8:60, in particular 8:50.

Figure 7:
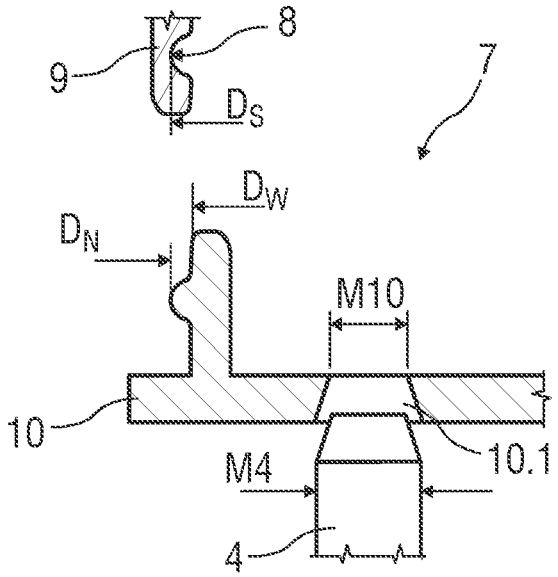
FIG. 7 schematically shows a sectional view of a detail of FIG. 6.

Housing pot 9 and housing cover 10 are connected to one another by means of a snap connection, wherein FIG. 7 showing a detail of electrical assembly 7 in the area of this snap connection.

To produce this snap connection, housing cover 10 has the diameter $D_N$ in the region of a bulge formed on a snap nose. A diameter $D_W$ of the snap nose and an inside diameter $D_S$ of a complementary section of housing pot 9 are designed such that a press fit is additionally produced between housing pot 9 and housing cover 10, wherein housing cover 10 relative to housing pot 9 hereby in particular has an oversize of 50 μm to 300 μm, preferably an oversize of 100 μm on average.

Furthermore, contact pins 4 are each guided by a press fit through the respective opening 10.1 of housing cover 10. In this case, a dimension M4 of the corresponding contact pin 4 has, for example, an oversize of 50 μm to 300 μm, in particular an oversize of 100 μm on average, relative to a clear dimension M10 of the associated opening 10.1 into which it is pressed.

Figure 8:
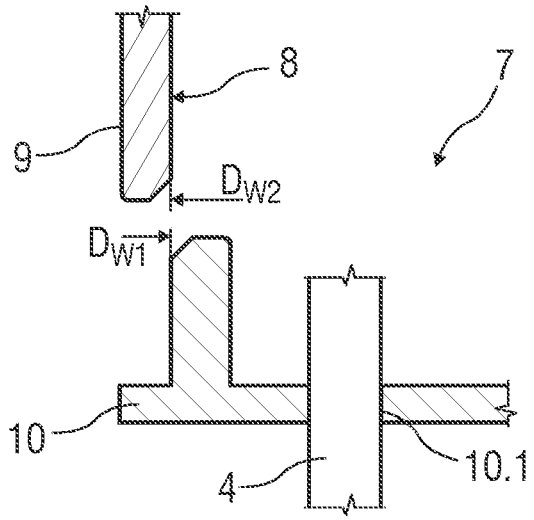
FIG. 8 schematically shows a sectional exploded view of a detail of an electrical assembly.

A sectional exploded view of a detail of an electrical assembly 7 is shown in FIG. 8, wherein in contrast to the exemplary embodiment shown in FIG. 6, only a press fit is produced between housing pot 9 and housing cover 10, wherein in this case a diameter $D_{W1}$ of housing cover 10 in particular has an oversize of 50 μm to 300 μm, preferably an oversize of 100 μm on average, relative to a diameter $D_{W2}$ of housing pot 9.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An electrical assembly comprising:

a housing comprising a housing pot and a housing cover closing the housing pot; and at least two connection terminals provided for an electrical connection of the assembly, each of the at least two connection terminals comprising:

a base plate;

a clamping plate arranged on the base plate to clamp at least one electrical conductor between the base plate and the clamping plate;

a contact pin protruding into the housing pot; and a screw to fasten the clamping plate to the base plate, wherein the housing pot is a hollow cylinder with a closed bottom, wherein the electrical connection terminals are arranged along an imaginary circular line on the housing, and wherein the base plates and/or the clamping plates have a trapezoidal base area.

2. The electrical assembly according to claim 1, wherein the contact pin is integrally formed on the base plate and is guided through the housing pot or the housing cover via a press fit.

3. The electrical assembly according to claim 1, wherein a circular opening for the passage of the screw is formed in the clamping plate and/or wherein the opening is arranged in an eccentric position in the clamping plate, and/or wherein the opening has a diameter of 3.5 mm.

4. The electrical assembly according to claim 3, wherein the circular opening is formed closer to a base side of the trapezoidal clamping plate than to an opposite base side of the clamping plate and/or at 30% to 50% or 40% to 50% or at approximately 45% or 45.7% of a distance from a longer base side to a shorter base side of clamping plate.

5. The electrical assembly according to claim 1, wherein the screw is captively held in the clamping plate by a form fit or a groove.

6. The electrical assembly according to claim 1, wherein a diameter of the cylindrical housing is between 45 mm and 55 mm, or between 49 mm and 51 mm, and/or wherein at least six connection terminals are arranged on a flattened side of the housing, and/or wherein a ratio of the diameter of the housing to the length of a respective base plate of a connection terminal is between 8:40 and 8:60 or is 8:50, and/or wherein a length of a longer base side of the clamping plate and/or the base plate is 8 mm, and/or wherein a length of a shorter base side of the clamping plate and/or the base plate is 6.4 mm, and/or wherein a distance between a longer base side and a shorter base side of the clamping plate and/or the base plate is 7 mm, and/or wherein a thickness of the clamping plate is 0.8 mm to 1.2 mm.

7. The electrical assembly according to claim 1, wherein the housing pot and the housing cover are connected to one another via a snap connection, a form fit, or a press fit, and wherein the housing pot relative to the housing cover or the housing cover relative to the housing pot has an oversize of 50 μm to 300 μm or an oversize of 100 μm on average.

8. The electrical assembly according to claim 1, wherein the housing pot and the housing cover each have a circular segment-shaped cutout on their edge, and/or each have a circular cutout in their center, and/or are integrally bonded to one another via a potting compound, and/or the housing is filled with a potting compound.

9. The electrical assembly according to claim 1, wherein at least one circuit board is fixed on the contact pins with a solder, and wherein the at least one circuit board is brought into contact with at least one integrally formed wall section of a housing part.

10. The electrical assembly according to claim 1, wherein wall sections formed toward the outside on the housing separate the base plates from one another, and/or wherein the base plates are fixed with wall sections to the housing part via a hot stamping process, and/or wherein the connection terminals are each covered by a cover, and wherein the cover has a circular cutout which is arranged centrally above the screw and has at least one coupling point for locking elements of a display.

* * * * *